US005901709A

United States Patent [19]

Chehab et al.

[11] Patent Number: 5,901,709

[45] Date of Patent: May 11, 1999

[54] METHOD OF AND APPARATUS FOR PROCESSING EXHAUSTED AIR IN TOBACCO PROCESSING PLANTS

[75] Inventors: Firdausia Chehab, Hamburg; Stefan Fietkau, Westerau; Frank Weimann, Lübeck, all of Germany

[73] Assignee: Hauni Maschinenbau AG, Hamburg, Germany

[21] Appl. No.: 08/820,705

[22] Filed: Mar. 18, 1997

Related U.S. Application Data

[63] Continuation of application No. 08/624,684, Mar. 25, 1996, abandoned.

[30] Foreign Application Priority Data

Apr. 22, 1995 [DE] Germany ..... 195 14 925

[51] Int. Cl.[6] ..... A24B 3/18

[52] U.S. Cl. ..... 131/109.2; 131/110; 131/280

[58] Field of Search ..... 131/109.2, 110, 131/108, 84.1, 84.4, 280

[56] References Cited

U.S. PATENT DOCUMENTS

| | | |
|---|---|---|
| 3,955,584 | 5/1976 | Molins . |
| 4,003,385 | 1/1977 | Adebahr et al. . |
| 4,055,192 | 10/1977 | Berlin . |
| 4,869,273 | 9/1989 | Heitmann et al. . |
| 4,969,551 | 11/1990 | Heitmann et al. . |
| 5,072,742 | 12/1991 | Heitmann . |
| 5,267,576 | 12/1993 | Heitmann . |
| 5,462,071 | 10/1995 | Heitmann . |

FOREIGN PATENT DOCUMENTS

| | | |
|---|---|---|
| 2 236 431 | 2/1975 | France . |
| 2 253 470 | 7/1975 | France . |
| 42 28 607 | 3/1994 | Germany . |
| 953792 | 4/1964 | United Kingdom . |
| 2 173 389 | 10/1986 | United Kingdom . |

*Primary Examiner*—John G. Weiss
*Attorney, Agent, or Firm*—Venable; George H. Spencer

[57] ABSTRACT

A first stream of contaminated air containing solid impurities including reusable tobacco particles is exhausted from a machine for the making of smokers' products and is caused to pass first through a first filter which separates therefrom all of the impurities, and the thus decontaminated air is caused to pass through a cooler and back to the machine. The separated impurities are caused to pass through a second filter which segregates therefrom the reusable tobacco particles, and such particles are reintroduced into the machine. The first stream of contaminated air can receive a second stream of contaminated air from a second machine, and such second stream is introduced into the first stream ahead of the first filter.

19 Claims, 1 Drawing Sheet

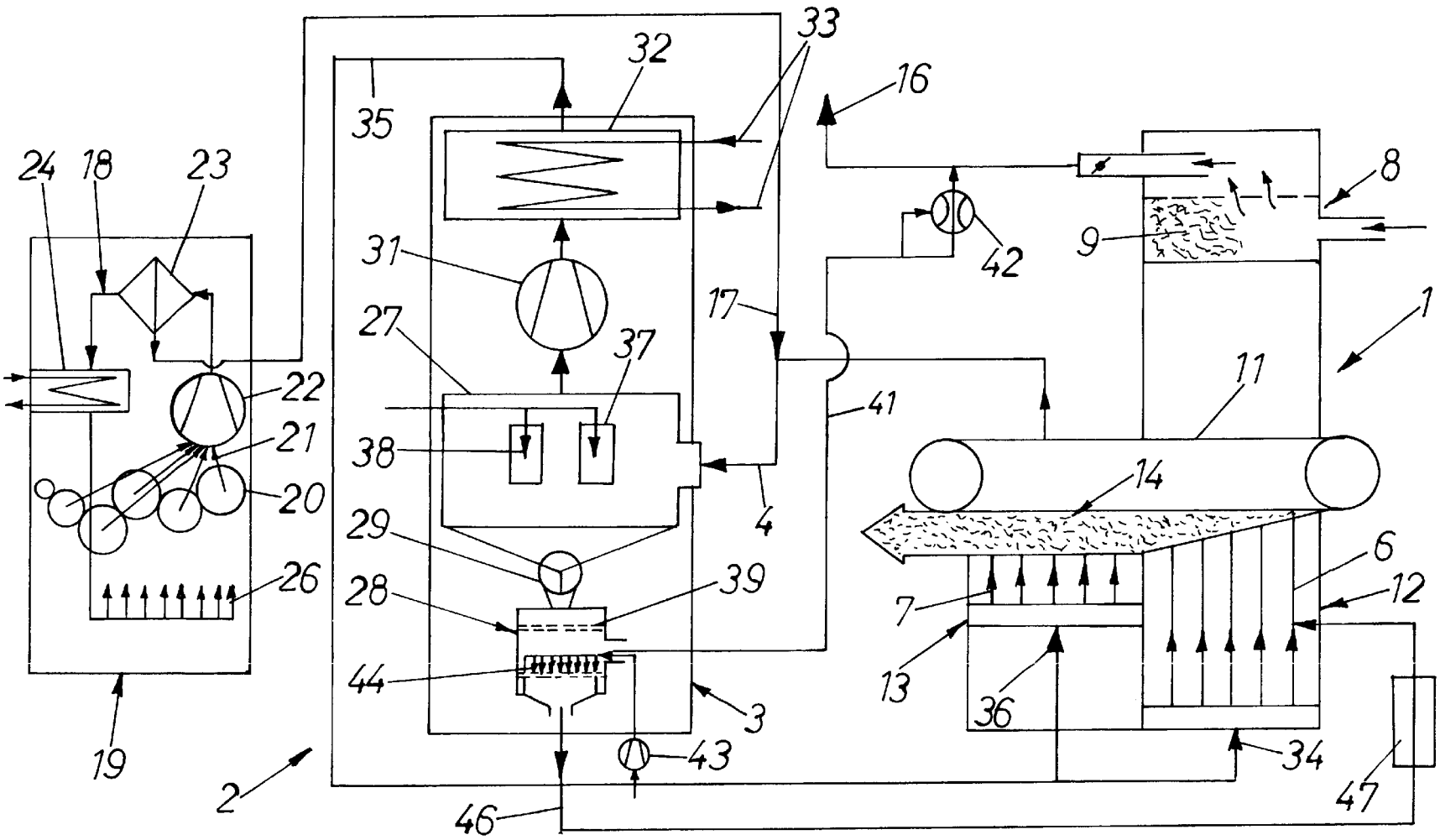
1
2
3
4
6
7
8
9
11
12
13
14
16
17
18
19
20
21
22
23
24
26
27
28
29
31
32
33
34
35
36
37
38
39
41
42
43
44
46
47

METHOD OF AND APPARATUS FOR PROCESSING EXHAUSTED AIR IN TOBACCO PROCESSING PLANTS

CROSS-REFERENCE TO RELATED CASE

This is a continuation of the patent application Ser. No. 08/624,684 filed Mar. 25, 1996, now abandoned.

BACKGROUND OF THE INVENTION

The invention relates to the processing of air in and around the machines which are used for the making of smokers' products incuding machines for the making of plain cigarillos, cigarettes, cigars or other rod-shaped articles which contain natural, synthetic and/or reconstituted tobacco, machines for the making of filter cigarettes, cigars, cigarillos and analogous articles of the tobacco processing industry, as well as the machines for the making of filter rods and filter rod sections for tobacco smoke.

Many types of machines for the making of smokers' products utilize large quantities of air for a variety of different purposes. For example, a machine for the making of plain cigarettes or a filter tipping machine (wherein plain cigarettes or other rod-shaped articles containing natural, reconstituted and/or synthetic tobacco are united with filter rod sections of unit length or multiple unit length to form filter cigarettes, cigars or the like) can utilize air for the transport of tobacco or filter material, for classification of randomly intermixed lighter and heavier and/or shorter or longer particles (such as mixtures of shreds of tobacco leaf laminae and fragments of tobacco eyes or ribs), for attracting webs of paper or the like or streams of tobacco and/or filter material to their conveyors, for attracting rod-shaped tobacco- and/or filter sections to the flutes of rotary conveyors or to other types of conveyors during transport and/or other manipulation, for testing rod-shaped articles and/or their constituents and/or for ejecting defective rod-shaped articles and/or their components. Air which is used for such purposes is normally laden with (i.e., it contains at least some) solid impurities including larger and/or smaller fragments of tobacco, larger and/or smaller fragments of filter material and/or other foreign bodies (such as pieces of rock, sand, metal or the like). Such contaminated air must be processed prior to reintroduction into a machine for the making of smokers' products and/or prior to admission into the surrounding atmosphere. Furthermore, it is often desirable to recover certain solid contaminants, such as certain sizes and/or types of tobacco particles, for reintroduction into the machine or machines for the making of rod-shaped and/or other smokers' products.

Certain heretofore known proposals to regenerate or recondition air which has been used in a machine for the making of smokers' products are described, for example, in British patent No. 953,792.

OBJECTS OF THE INVENTION

An object of the invention is to provide a simple but effective method of removing solid impurities from air which was contaminated in one or more machines for the making of smokers' products.

Another object of the invention is to provide a method which can be resorted to for the recivery of usable ingredients of air that was contaminated during passage through one or more machines for the making of smokers' products, for ensample, for the recovery of decontaminated air and/or for the recovery of reusable particles or fragments of tobacco.

A further object of the invention is to provide a method which can be used for simultaneous processing of contaminated air issuing or being withdrawn from several machines for the making of smokers' products.

An additional object of the invention is to provide a novel and improved method of decontaminating as well as otherwise treating or conditioning air which was contaminated in one or more machines for the making of smokers' products.

Still another object of the invention is to provide a method which contributes to the economy of the making of plain or filter cigarettes and/or other rod-shaped smokers' products.

A further object of the invention is to provide a novel and improved apparatus for the practice of the above outlined method.

Another object of the invention is to provide an apparatus which can be combined with or incorporated into existing machines and/or production lines for the making of plain or filter cigarettes and/or other types of smokers' products.

An additional object of the invention is to provide a method of and/or an apparatus for relieving the air conditioning systems which are used in tobacco processing plants.

Still another object of the invention is to provide a novel and improved module which can be put to use in the above outlined apparatus.

A further object of the invention is to provide an apparatus which can employ relatively small, simple and inexpensive filters or analogous solids separating or intercepting devices.

Another object of the invention is to provide an apparatus which can operate satisfactorily with relatively small fans and/or other types of circulating devices for contaminated, partially decontaminated and fully decontaminated air.

SUMMARY OF THE INVENTION

One feature of the present invention resides in the provision of a method of processing contaminated air which is laden with solid impurities (including reusable tobacco particles) during passage through a machine for the making of smokers' products, e.g., a cigarette making machine or a filter tipping machine. The method comprises the steps of at least partially decontaminating contaminated air including separating at least the reusable tobacco particles from contaminated air, cooling the at least partially decontaminated air, and introducing the separated reusable tobacco particles into a machine for the making of smokers' products, e.g., into the machine from which the contaminated air was withdrawn.

The separating step can include simultaneously separating reusable tobacco particles and other solid impurities from contaminated air so that the body of air which is cooled is a least substantially devoid of solid impurities.

The method can further comprise the step of admitting, prior to the separating step, into contaminated air at least one stream of air which contains solid impurities free or already free of reusable tobacco particles.

The separating step can comprise separating all of the solid impurities from contaminated air, and such method can further comprise the step of segregating reusable tobacco particles from other solid impurities subsequent to the separating step and prior to the introducing step.

The method can also comprise the step of introducing the at least partially decontaminated air into at least one machine for the making of smokers' products, e.g., into the machine from which the contaminated air was withdrawn or expelled.

The cooling step can comprise conveying the at least partially decontaminated air through at least one heat exchanger, e.g., through one or more heat exchangers wherein the at least partially decontaminated air exchanges heat with water.

Another feature of the invention resides in the provision of an apparatus for processing contaminated air which is laden with (i.e., which takes along at least some) solid impurities, including reusable tobacco particles, during passage through a machine for the making of smokers' products. The improved apparatus comprises means for at least partially decontaminating contaminated air, including means for separating at least the reusable tobacco particles from contaminated air, means for cooling the at least partially decontaminated air, and means for introducing the separated reusable tobacco articles into at least one machine for the making of smokers' products, e.g., into the machine from which the contaminated air was withdrawn.

The apparatus can further comprise means for conveying the contaminated air and at least partially decontaminated air in a predetermined direction along a predetermined path first past or through the separating means and thereupon past or through tile cooling means. The introducing means can include means for conveying the separated reusable tobacco particles from the separating means in a second direction other than (e.g., counter to) the predetermined direction.

The separating means can include at least one filter which serves to separate all of the solid impurities from the contaminated air, i.e., the air which reaches the cooling means is devoid of solid contaminants or impurities.

The introducing means can include means for segregating reusable tobacco particles from all or at least some other impurities.

As already mentioned above, the apparatus can further comprise means for conveying contaminated air and the at least partially decontaminated air in a predetermined direction along a predetermined path first past or through the separating means and thereafter past or through the cooling means, and such apparatus can further comprise means for admitting, upstream of or at the separating means, at least one stream of air which contains solid impurities free of reusable tobacco particles. The means for admitting can include means for conveying the at least one stream of air from a machine having internal (i.e., its own) means for separating at least some contaminants from contaminated air which is laden with solid impurities including reusable tobacco particles.

The apparatus can further comprise means for conveying cooled at least partially decontaminated air from the cooling means to a machine for the making of smokers' products, e.g., to the machine from which the contaminated air was expelled or withdrawn.

The cooling means can include at least one heat exchanger; for example, the cooling means can include means for removing heat from the at least partially decontaminated air by exchange of heat with water.

The cooling means and the separating means can constitute component parts of a module. Such module can further include the aforementioned means for segregating reusable tobacco particles from other solid impurities.

The novel features which are considered as characteristic of the invention are set forth in particular in the appended claims. The improved method and apparatus themselves, however, both as to their steps and components, will be best understood upon perusal of the following detailed description of certain presently preferred specific embodiments with continuous reference to the accompanying drawings.

BRIEF DESCRIPTION OF THE DRAWINGS

The single FIGURE of the drawings is a diagrammatic view of an apparatus designed to process contaminated air issuing from a first machine for the making of smokers' products and partially decontaminated air issuing from a second machine for the making of smokers' products.

DESCRIPTION OF PREFERRED EMBODIMENTS

The apparatus which is shown in the single FIGURE is designed to process contaminated air which is withdrawn or expelled from a first machine 1 for the making of smokers' products, and partially decontaminated air which is expelled or withdrawn from a second machine 19 for the making of smokers' products. The machine 1 constitutes a cigarette making machine, and the machine 19 is a so-called filter tipping machine wherein plain cigarettes of unit length are assembled with filter mouthpieces to form plain cigarettes of unit length.

The arrow 4 indicates the path and the direction of evacuation of contaminated air from the machine 1 into a module 2, and the arrow 17 indicates the direction and the path of flow of a stream of at least partially decontaminated air from the machine 19 into the path denoted by the arrow 4, i.e., also into the module 2. The module 2 includes a unit 3 which includes a filtering arrangement or filter 27 serving as a means for at least partially (but preferably completely) separating solid impurities from contaminated air which is supplied in the direction of the arrow 4. The thus at least partially decontaminated air is conveyed by a blower 31 of the unit 3 through a cooling system 32, and the arrow 35 indicates the direction of return flow of cooled or conditioned air to inlets 34 and 36 where the conditioned and decontaminated air is introduced into the machine 1.

The arrows 6 denote the direction of flow of reintroduced reconditioned or decontaminated air in a duct 12 which forms part of the machine 1 and wherein the air serves to advance a shower of larger and smaller tobacco particles toward the underside of the lower reach of an endless foraminous conveyor 11 which gathers (in a zone 13) a filler stream 14 containing tobacco particles and being attracted to the conveyor 11 by streamlets of conditioned air entering at the inlet 36 and flowing in directions indicated by the arrows 7.

It will be seen that, in that portion of the machine 1 which is shown in the single FIGURE, air flowing in the directions indicated by arrows 6 serves to directly transport tobacco particles in the duct 12 toward and against the lower reach of the endless foraminous conveyor 11, and additional air (flowing in the directions indicated by the arrows 7) serves to ensure that the conveyor 11 can advance the growing and fully grown filler stream 14 toward the next processing stations, not shown. Air entering a suction chamber between the upper and lower reaches of the conveyor 11 is laden with solid particles including reusable fragments of tobacco, small or very small particles of tobacco as well as particles of sand and/or other foreign matter. Such contaminated air is conveyed in a direction and along a path indicated by the arrow 4, i.e., from the suction chamber into the module 2 for decontamination and for recovery of reusable tobacco particles.

The machine 1 further comprises a gate 8 which receives tobacco 9 from a main source of supply (not shown) by way of a pneumatic conveyor and delivers (when necessary) batches of tobacco into the distributor (not shown) of the machine 1. Though it is within the purview of the present invention to introduce contaminated air from the gate 8 into the module 2, the single FIGURE shows a conduit 16 which conveys contaminated air from the gate 8 into the central dedusting apparatus (not shown) of the tobacco processing plant. The bodies of air flowing in the directions indicated by the arrows 4, 6 and 7 flow continuously when the machine 1 is in use; on the other hand, air enters and leaves the gate 8 at required intervals, i.e., intermittently.

The arrow 17 indicates the direction of flow of a partially decontaminated air stream from the second machine 19 into the path indicated by the arrow 4, i.e., into the stream of contaminated air flowing from the suction chamber between the upper and lower reaches of the conveyor 11 into the module 2. The machine 19 contains or is associated with a filtering assembly 18 which is or can be designed to relieve contaminated air from all solid particles and to recirculate the thus decontaminated air into certain component parts of the machine 19 (as indicated by the arrows 26). The character 20 denotes one of several rotary conveyors normally having axially parallel peripheral flutes for reception and temporary retention of rod-shaped articles (such as filter rod sections of unit length and/or multiple unit length, plain cigarettes of unit length and filter cigarettes of unit length or multiple unit length). Air which leaves the conveyors 20 flows in directions indicated by arrows 21 and normally contains some solid particles; such air is conveyed or propelled by a blower 22 to flow, preferably in its entirety, into and through a separator 23, e.g., a separator known as Cooper cyclone. The separator 23 conveys about 90 percent of decontaminated (filtered) air to a cooling unit 24 whence the decontaminated and cooled air flows in the direction of arrows 26, i.e., to be reused in the machine 19. The remaining ten percent of air supplied to the separator 23 by the blower 22 contain a relatively high percentage of solid particles (mostly or exclusively small tobacco particles), and such air is conveyed in the direction of the arrow 17 to form a stream which is merged into the stream flowing in the direction of the arrow 4 at a locus preferably prior to admission of air issuing from the machine 1 into the module 2.

The module 2 comprises several components including the aforementioned filter 27 which can or which is intended to relieve contaminated air (admitted in the direction of the arrow 4) of all solid particles, a second filter 28 which is designed to segregate reusable tobacco particles from other solid particles downstream of the filter 27, a cell wheel gate 29 in the path of air between the filters 27 and 28, the blower 31 which conveys decontaminated air from the filter 27 in a direction other than (e.g., counter to) that of advancement of separated solid particles from the filter 27 toward the filter 28, and the aforementioned cooling system 32.

The filter 27 can be a solids separating unit known as Mahle Industrial Filter Type SFK 1560 (distributed by Knecht Filterwerke GmbH, Öhringen, Federal Republic Germany).

The second filter 28 of the module 2 can be constructed and assembled in a manner as disclosed, for example, in published German patent application No. 36 08 741 or 24 01 324 or 41 07 642.

The cooling system 32 can be of the type disclosed in commonly owned U.S. Pat. No. 5,462,071. The disclosure of this patent is incorporated herein by reference. The patented system employs at least one heat exchanger 33, preferably a heat exchanger which utilizes water being relieved of heat outside of the building or area in which the machines 1, 19 (and normally numerous additional machines) are installed.

Contaminated air flowing in the direction of the arrow 4 is or can be admitted directly into the filter 28 which intercepts all solid impurities including reusable tobacco fragments, tobacco dust as well as foreign materials such as pieces of rock, sand, metallic pieces and/or others. The thus decontaminated air is conveyed by the blower 31, is cooled during passage through the system 32, and is conveyed along a path indicated by the arrow 35 for reintroduction into the machine at the inlets 34 and 36.

The filter 27 includes a plurality of filtering cartridges 37 (only two shown in the single FIGURE) which are regularly and alternately cleaned by jets of compressed air (indicated at 38). The thus expelled solid particles advance from the cartridges 37 into the cell wheel gate 29 to be admitted into the filter 28. The latter can comprise a driven rotary drum 39 with a sieve which segregates reusable tobacco particles or fragments from smaller solid particles, and the smaller particles are caused to leave the module 2 by way of a conduit 41 containing an air pressure regulator 42 which controls the admission of contaminated air from the conduit 41 into that indicated by the arrow 16. The reusable tobacco particles gather at the periphery of the drum 39 and are acted upon by jets of compressed air furnished by a blower 43 so that the reusable particles leave the filter 28 in directions indicated by the arrows 44 to advance along the path indicated by the arrow 46 and to be introduced into the duct 12 by an ejector 47.

The manner in which particles of tobacco can be introduced or reintroduced into a machine for the making of smokers' products (such as a cigarette maker) is described, for example, in U.S. Pat. Nos. 4,003,385, 4,869,273 and 5,267,576. The disclosures of these patents are incorporated herein by reference.

An important advantage of the improved method and apparatus is that the module 2 can employ a relatively small (compact) filter 28 or an equivalent filter. The reason is that this filter need not be designed for the passage of large quantities of air.

Though it is possible to separate smaller and larger solid particles from contaminated air, which enters the module 2 in the direction of the arrow 4, in a plurality of successive stages, it is presently preferred to employ the aforedescribed filter 28 or an equivalent filter which is capable of relieving contaminated air of all, or practically all, solid particles so that the stream or streams of air passing through the blower 31 and cooling system 32 are ready to reenter the machine 1 without the need for additional filtering. It is clear that decontaminated and cooled air leaving the cooling system 32 need not be conveyed to, or only to, the machine 1 but can be discharged into the atmosphere or admitted into at least one other machine for the making or processing of smokers' products.

The coupling of the second machine 19 with the module 2 constitutes a desirable but optional feature of the improved method and apparatus. As stated above, the apparatus 19 is assumed to be a filter tipping machine, namely a machine wherein the circulating contaminated air normally contains only very small solid particles, and such solid particles can be readily separated from air during passage through the filter 28. As already mentioned above, a high percentage of decontaminated air which has passed through the cyclone separator 23 can be cooled at 24 and reintroduced into selected component parts (such as 20) of the machine 19 by being caused to flow in the directions indicated by the arrows 26.

The segregation of small solid impurities from reusable tobacco particles in the filter 28 of the module 2 necessitates the utilization of relatively small quantities of air. This contributes to the aforementioned desirable compactness and relative simplicity of the filter 28.

In addition to or in lieu of returning decontaminated air from the cooling system 32 into the machine 1, such air can be introduced into the air conditioning system for the area in which the machines 1 and 19 are installed. This would render it possible to employ a simpler, more compact and less expensive air conditioning system. However, it is presently preferred to return at least a portion of decontaminated air (which was cooled at 32) into the machine 1, i.e., into a machine for the making of smokers' products, for example, into the same machine from which contaminated air was withdrawn in the direction of the arrow 4.

Though it is possible to replace the illustrated cooling system 32 with a system wherein air supplied by the blower 31 exchanges heat with air in the surrounding atmosphere, it is often desirable and advantageous to relieve the air conditioning system for the area in which the machines 1 and 19 are installed by employing a heat exchanger (33) which can operate with water and the heat exchange medium of which is cooled outside of the aforementioned area.

An advantage of the feature that the path for the flow of decontaminated air from the filter 27 toward and through or past the cooling system 32 is different from the path for the conveying of solid particles which were separated from contaminated air at 27 is that the treatment of decontaminated air can be selected independently of the treatment of separated solid particles and vice versa. In other words, it is possible to select optimum procedures for the treatment of decontaminated air on the one hand, and for the treatment of separated solid particles on the other hand because the two treatments cannot or need not interfere with each other. For example, segregation of small tobacco particles and other solid matter from reusable tobacco particles in the filter 28 can be completed with the utilization of relatively small quantities of air which renders it possible to employ one or more relatively small blowers, fans or other air conveying or circulating means (such as the blower 43) with attendant reduction of wear and smaller space requirements, and to employ a relatively simple and compact filter 28.

Though the improved apparatus is particularly suitable for use in or in conjunction with machines (such as the machine 1) or production lines which generate relatively large quantities of dust and/or other solid contaminants, such apparatus can be utilized with equal or similar advantage for the decontamination of air which is used in machines (such as 19) wherein the air is contaminated primarily by relatively small or very small solid particles which, at least as a rule, are not to be returned for reuse in a machine for the making of smokers' products. However, contaminated air leaving the machine 19 can be readily decontaminated in the improved apparatus, for example, as shown in the single FIGURE which indicates that a stream of contaminated air (arrow 17) can be admixed to contaminated air (arrow 4) flowing from a machine 1 wherein air is likely to be contaminated by relatively small solid particles as well as by reusable fragments of tobacco.

Another advantage of the illustrated cooling system 32 is that the extent or degree of cooling of decontaminated air by the externally installed heat exchanger 33 can be selected practically at will, and also that the withdrawal of heat from decontaminated air does not result in additional heating of the atmosphere surrounding the machines 1 and 19.

The assembly of the cooling system 32 and filters 27, 28 into a unitary structure or module 2 constitutes an optional but desirable feature of the improved apparatus.

A machine for the making of plain cigarettes is disclosed, for example, in commonly owned U.S. Pat. No. 5,072,742, and a filter tipping machine is disclosed, for example, in commonly owned U.S. Pat. No. 4,969,551. The disclosures of these patents are also incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of removing solid impurities from gaseous fluids and, therefore, such adaptations should and are intended to be comprehended within the meaning and range of equivalence of the appended claims.

What is claimed is:

1. A method of processing contaminated air which is laden with solid impurities, including reusable tobacco particles, during passage through a machine for the making of smokers' products, comprising the steps of admitting into said contaminated air at least one stream of air which contains impurities at least substantially free of reusable tobacco particles; at least partially decontaminating said contaminated air and said admitted stream of air, including separating at least the reusable tobacco particles therefrom; and introducing the separated reusable tobacco particles into at least one machine for the making of smokers' products.

2. The method of claim 1, wherein said separating step includes simultaneously separating reusable tobacco particles and other solid impurities from contaminated air.

3. The method of claim 1, further comprising the step of admitting into contaminated air at least one stream of air, which contains solid impurities free of reusable tobacco particles, prior to said separating step.

4. The method of claim 1, wherein said separating step comprises separating all of the solid impurities from said contaminated air and from said at least one stream of air, and further comprising the step of segregating reusable tobacco particles from other solid impurities subsequent to said separating step and prior to said introducing step.

5. The method of claim 1, further comprising the step of introducing the at least partially decontaminated air into a machine for the making of smokers' products.

6. Apparatus for processing contaminated air which is laden with solid impurities, including reusable tobacco particles, during passage through a machine for the making of smokers' products, comprising means for at least partially decontaminating said contaminated air, including means for separating at least the reusable tobacco particles from said contaminated air; and means for introducing the separated reusable tobacco particles into a machine for the making of smokers' products, including means for segregating reusable tobacco particles from other solid impurities.

7. The apparatus of claim 6, further comprising means for conveying the contaminated and at least partially decontaminated air in a predetermined direction along a predetermined path past said separating and means.

8. The apparatus of claim 7, wherein said introducing means includes means for conveying the separated reusable tobacco particles from said separating means in a second direction other than said predetermined direction.

9. The apparatus of claim 6, wherein said separating means includes at least one filter arranged to separate all of the solid impurities from contaminated air.

10. The apparatus of claim 6, wherein said introducing means includes means for segregating reusable tobacco particles from other solid impurities.

11. The apparatus of claim 6, further comprising means for conveying said contaminated air in a predetermined direction along a predetermined path past said separating and thereafter means, and means for admitting into said path at least one stream of air, which contains solid impurities at least substantially free of reusable tobacco particles, upstream of said separating means.

12. The apparatus of claim 11, wherein said means for admitting includes means for conveying said at least one stream of air from at least one second machine having internal means for separating reusable tobacco particles from air which was contaminated in said at least one second machine and is laden with solid impurities including reusable tobacco particles.

13. The apparatus of claim 6, further comprising means for conveying at least partially decontaminated air from said cooling means to said machine.

14. The apparatus of claim 6, wherein said said separating means forms part of a module.

15. The apparatus of claim 14, wherein said introducing means includes means for segregating reusable tobacco particles from other solid impurities and said segregating means forms part of said module.

16. A method of processing contaminated air which is laden with solid impurities, including reusable tobacco particles, during passage through a machine for the making of smokers' products, comprising the steps of at least partially decontaminating said contaminated air including separating all of the solid impurities therefrom; thereafter segregating reusable tobacco particles from other solid impurities; and thereafter introducing the segregated reusable tobacco particles into at least one machine for the making of smokers' products.

17. Apparatus for processing contaminated air which is laden with solid impurities, including reusable tobacco particles, during passage through a machine for the making of smokers' products, comprising means for at least partially decontaminating said contaminated air, including means for separating at least the reusable tobacco particles from said contaminated air; means for conveying said contaminated air in a predetermined direction along a predetermined path past said separating means; means for admitting into said path at least one stream of air, which contains solid impurities at least substantially free of reusable tobacco particles, upstream of said separating means; and means for introducing the separated reusable tobacco particles into a machine for the making of smokers' products.

18. The apparatus of claim 17, wherein said means for admitting includes means for conveying said at least one stream from a second machine having internal means for separating reusable tobacco particles from air which was contaminated in said second machine and is laden with solid impurities.

19. Apparatus for processing contaminated air which is laden with solid impurities, including reusable tobacco particles, during passage through a machine for the making of smokers' products, comprising means for at least partially decontaminating said contaminated air, including means for separating at least the reusable tobacco particles from said contaminated air; and means for introducing the separated reusable tobacco particles into a machine for the making of smokers' products, said introducing means including means for segregating reusable tobacco particles from other solid impurities, said segregating means and said separating means forming part of a module.

* * * * *